US009726363B2

(12) United States Patent
Arai

(10) Patent No.: US 9,726,363 B2
(45) Date of Patent: Aug. 8, 2017

(54) LIGHT-EMITTING DEVICE

(71) Applicants: CITIZEN ELECTRONICS CO., LTD., Yamanashi-ken (JP); CITIZEN WATCH CO., LTD., Tokyo (JP)

(72) Inventor: Takahiro Arai, Fujiyoshida (JP)

(73) Assignees: CITIZEN ELECTRONICS CO., LTD., Yamanashi-Ken (JP); CITIZEN WATCH CO., LTD., Tokyo (JP)

( * ) Notice: Subject to any disclaimer, the term of this patent is extended or adjusted under 35 U.S.C. 154(b) by 8 days.

(21) Appl. No.: 14/967,919

(22) Filed: Dec. 14, 2015

(65) Prior Publication Data

US 2016/0245497 A1 Aug. 25, 2016

Related U.S. Application Data

(60) Provisional application No. 62/118,651, filed on Feb. 20, 2015.

(51) Int. Cl.

| | |
|---|---|
| ***F21V 29/61*** | (2015.01) |
| ***F21V 29/63*** | (2015.01) |
| ***F21K 9/233*** | (2016.01) |
| *F21V 23/02* | (2006.01) |
| *F21V 29/83* | (2015.01) |
| *F21Y 115/10* | (2016.01) |

(52) U.S. Cl.

CPC ..... *F21V 29/61* (2015.01); *F21K 9/233* (2016.08); *F21V 29/63* (2015.01); *F21V 23/02* (2013.01); *F21V 29/83* (2015.01); *F21Y 2115/10* (2016.08)

(58) Field of Classification Search

CPC ..... F21V 29/61; F21V 29/63; F21V 29/83; F21V 23/02; F21K 9/233; F21Y 2115/10; F21S 48/32

See application file for complete search history.

(56) References Cited

U.S. PATENT DOCUMENTS

| | | | | |
|---|---|---|---|---|
| 5,008,582 | A * | 4/1991 | Tanuma | H01L 23/467 257/E23.099 |
| 7,550,901 | B2 * | 6/2009 | Chrysler | F04D 33/00 310/311 |
| 9,500,355 | B2 * | 11/2016 | Kuenzler | F21V 7/048 |
| 2005/0031464 | A1 * | 2/2005 | Huang | F21S 9/04 417/352 |
| 2009/0160302 | A1 | 6/2009 | Imai et al. | |
| 2010/0026185 | A1 | 2/2010 | Betsuda et al. | |
| 2011/0063800 | A1 * | 3/2011 | Park | F04D 33/00 361/697 |
| 2011/0122582 | A1 * | 5/2011 | Park | F21V 29/02 361/697 |

(Continued)

*Primary Examiner* — Joseph L Williams
*Assistant Examiner* — Jose M Diaz
(74) *Attorney, Agent, or Firm* — Wenderoth, Lind & Ponack, L.L.P.

(57) ABSTRACT

In a first aspect of the present inventive subject matter, a light-emitting device includes a magnetic circuit including a magnetic gap; a movable member including a coil that is electrically connectable to an alternating current power source and arranged in the magnetic gap of the magnetic circuit; and a light source including a light-emitting diode and arranged above the movable member, and the movable member is able to be activated with a voltage falling in a range of one to five percent of an entire voltage range that is applicable to the light-emitting device.

17 Claims, 4 Drawing Sheets

(56) References Cited

U.S. PATENT DOCUMENTS

| | | | | |
|---|---|---|---|---|
| 2011/0132900 | A1* | 6/2011 | Kinoshita | F24C 7/04 219/647 |
| 2013/0294068 | A1* | 11/2013 | Kuenzler | F21V 7/048 362/234 |
| 2016/0281935 | A1* | 9/2016 | Yang | F21K 9/69 |

* cited by examiner

LIGHT-EMITTING DEVICE

CROSS-REFERENCE TO RELATED APPLICATION

This application is a new U.S. patent application that claims benefit of U.S. provisional application No. 62/118,651, filed on Feb. 20, 2015, the disclosures of which are incorporated herein by reference in its entirety.

BACKGROUND OF THE INVENTION

Field of the Invention

The present invention relates to a light-emitting device including a light source that includes a light-emitting diode (LED), and relates to a light-emitting device including a heat-releasing structure.

Description of the Related Art

A light-emitting device including an LED and a heat-releasing structure is known to the public.

For example, it is open to the public that a light-emitting device includes a base made of a metallic material and light-emitting diodes (LEDs) thermally connected to the base (For reference, see U.S. Unexamined Patent Application Publication No. 2009/0160302 A1).

Also, it is open to the public that a lamp includes an air-cooling unit including a motor and a fan that is rotary-driven by the motor (For reference, see U.S. Unexamined Patent Application Publication No. 2010/0026185 A1).

SUMMARY OF THE INVENTION

In a first aspect of the present inventive subject matter, a light-emitting device includes a magnetic circuit including a magnetic gap; a movable member including a coil that is electrically connectable to an alternating current power source and arranged in the magnetic gap of the magnetic circuit; and a light source including a light-emitting diode and arranged above the movable member, and the movable member is able to be activated with a voltage falling in a range of one to five percent of an entire voltage range that is applicable to the light-emitting device.

In a second aspect of the present inventive subject matter, a light-emitting device includes a casing including an opening; alight source supported by the casing; an air passage arranged adjacent to the light source; a magnetic circuit including a yoke, a permanent magnet arranged in contact with the yoke, a top plate arranged on the permanent magnet to form a magnetic gap between the top plate and the yoke; and a movable member being positioned below the light source in the casing and including a coil that is arranged in a magnetic gap.

In a third aspect of the present inventive subject matter, a light-emitting device includes a magnetic circuit including a yoke, a permanent magnet arranged in contact with the yoke, and a top plate arranged on the permanent magnet to form a magnetic gap between the top plate and the yoke; a movable member including a coil to which an alternating current is supplied when the light-emitting device is activated; a rectifier to which the alternating current is supplied when the light-emitting device is activated; and a light source to which a rectified current rectified from the alternating current by the rectifier is supplied when the light-emitting device is activated, the coil of the movable member to which the alternating current is configured to be supplied before the alternating current is supplied to the rectifier.

DETAILED DESCRIPTION OF THE EMBODIMENTS

As used herein, the term "and/or" includes any and all combinations of one or more of the associated listed items.

The terminology used herein is for the purpose of describing particular embodiments only and is not intended to be limiting of the subject matter. As used herein, the singular forms "a", "an" and "the" are intended to include the plural forms as well, unless the context clearly indicates otherwise.

As illustrated in the figures submitted herewith, some sizes of structures or portions may be exaggerated relative to other structures or portions for illustrative purposes. Relative terms such as "below" or "above" or "upper" or "lower" may be used herein to describe a relationship of one element, layer or region to another element, layer or region as illustrated in the figures. It will be understood that these terms are intended to encompass different orientations of a device in addition to the orientation depicted in the figures.

Embodiments of the invention now will be described more fully hereinafter with reference to the accompanying drawings, in which embodiments of the invention are shown. This invention may, however, be embodied in many different forms and should not be construed as limited to the embodiments set forth herein. Rather, these embodiments are provided so that this disclosure will be thorough and complete, and will fully convey the scope of the invention to those skilled in the art.

Embodiments of the invention are described with reference to drawings included herewith. Same and/or similar reference numbers refer to same and/or similar and/or corresponding and/or related structures throughout. It should be noted that the drawings are schematic in nature.

Figure 1A:
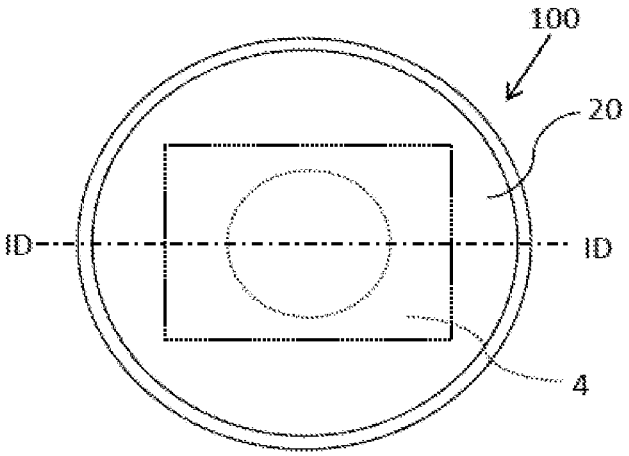
FIG. 1A shows a top plan view of a light-emitting device as an embodiment of the present invention.
Figure 1B:
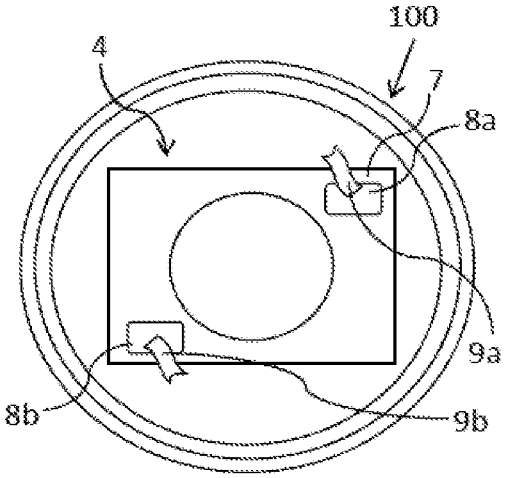
FIG. 1B shows a top plan view of the light-emitting device shown in FIG. 1A, with a light-transmitting cover removed.
Figure 1C:
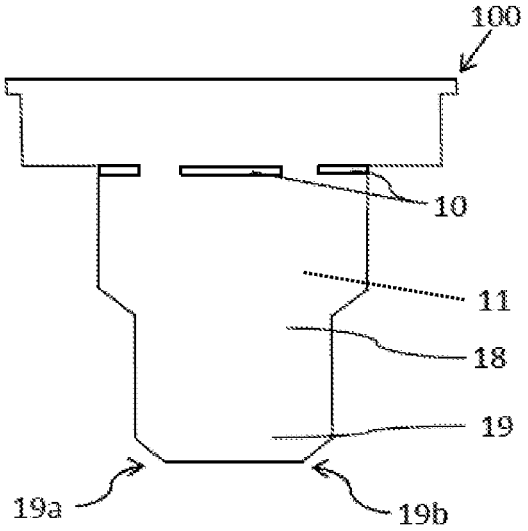
FIG. 1C shows a side view of a light-emitting device as an embodiment of the present invention.
Figure 1D:
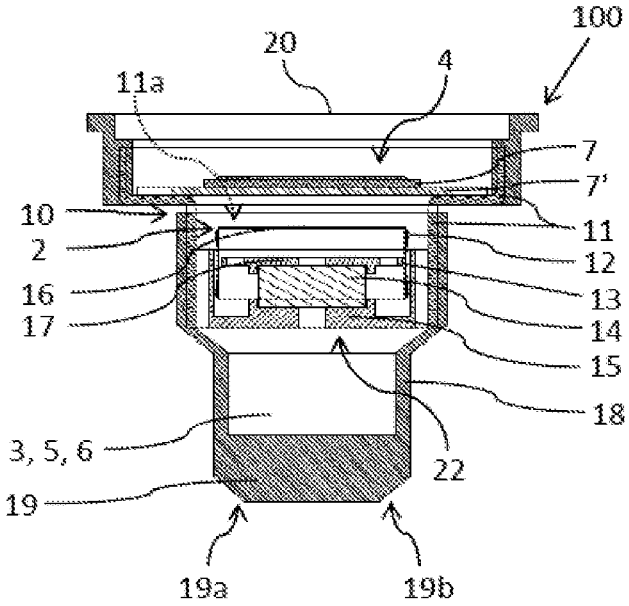
FIG. 1D is a cross-sectional view of a light-emitting device as an embodiment of the present invention, taken along a dotted and dashed line ID-ID shown in FIG. 1A.

FIG. 1D is a cross-sectional view of a light-emitting device as an embodiment of the present invention, taken along a dotted and dashed line ID-ID shown in FIG. 1A.

Figure 2A:
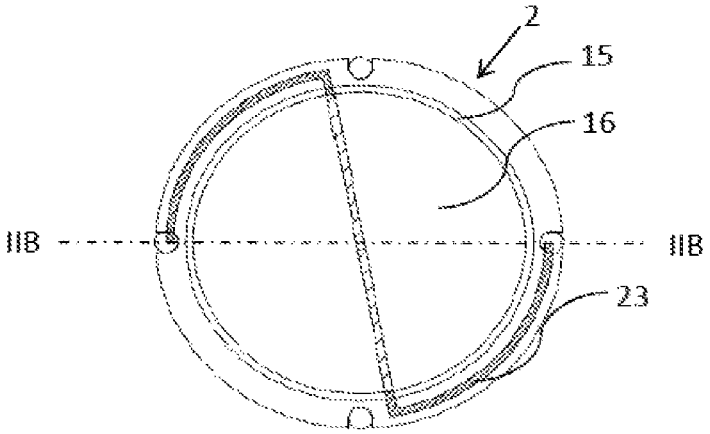
FIG. 2A shows a top plan view of a movable member of a light-emitting device according to an embodiment of the present invention.
Figure 2B:
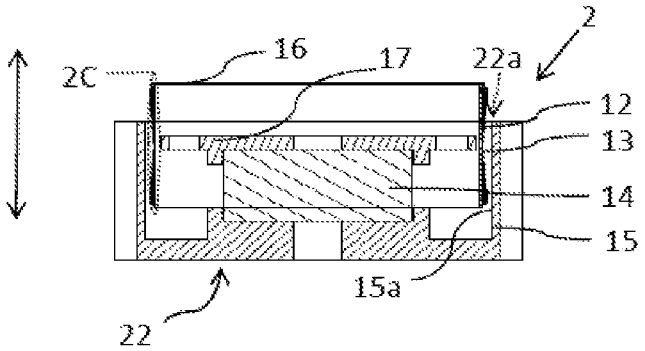
FIG. 2B is a cross-sectional view of a movable member arranged in a magnetic gap of a magnetic circuit, and taken along a dotted and dashed line IIB-IIB shown in FIG. 2A.

FIG. 2B is a cross-sectional view of a movable member arranged in a magnetic gap of a magnetic circuit, and taken along a dotted and dashed line IIB-IIB shown in FIG. 2A.

According to an embodiment of a light-emitting device of the subject invention, the light-emitting device 100 includes a magnetic circuit 22 including a magnetic gap 22*a*; a movable member 2 including a coil 12 that is electrically connectable to an alternating current (AC) power source and arranged in the magnetic gap 22*a* of the magnetic circuit 22; and a light source 4 including an LED and arranged above the movable member 2.

In an alternating current (AC), the flow of electric charge periodically reverses direction. AC is the form in which electric power is delivered to businesses and residences, and thus, an alternating current power source 1 is positioned outside of the light-emitting device 100.

The movable member 2 is able to be activated with a voltage that is applied to the coil 12. The voltage that is applicable to the coil 12 may fall in a range of one to five percent of an entire voltage range applicable to the light-emitting device 100. Accordingly, the movable member 2 with the coil 12 arranged in the magnetic gap 22*a* of the magnetic circuit 22 is able to be activated by a comparatively small voltage range in an entire voltage range to the light-emitting device.

Figure 3:
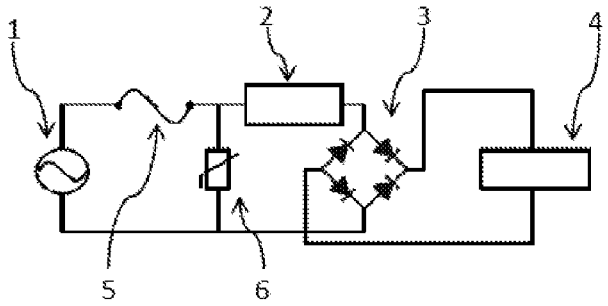
FIG. 3 shows a circuit diagram for a light-emitting device according to an embodiment of the present invention.

FIG. 3 shows a circuit diagram for a light-emitting device according to an embodiment of the present invention.

The light-emitting device 100 may further include a rectifier 3 that is electrically connectable to an AC power source 1. The rectifier 3 is configured to rectify an AC originating from the AC power source 1 to supply a rectified current to the light source 4. The light-emitting device 100 may include parts that include a fuse 5 and a varistor 6. A fuse is a device used in an electrical device and/or system to protect against an excessive current. A varistor is an electronic component with an electrical resistivity that varies with a voltage applied.

Also, the reference number 5 shown in FIG. 3 is a fuse.

FIG. 2A shows a top plan view of a movable member of a light-emitting device according to an embodiment of the present invention.

The movable member 2 may further include a panel 16 arranged on the coil 12. The word "panel" here includes a diaphragm. The magnetic circuit 22 may include a yoke 15, a permanent magnet 14 arranged on the yoke 15, and a top plate 17 arranged on the permanent magnet 14 to form a magnetic gap 22*a* between the top plate 17 and the yoke 15. The permanent magnet 14 may be arranged in a recessed portion 15*a* of the yoke 15, and a lower portion of the permanent magnet 14 is in contact with the yoke 15.

FIG. 1C shows a side view of a light-emitting device as an embodiment of the present invention.

As shown in FIG. 1D that is a cross-sectional view of a light-emitting device, the light-emitting device 100 may further include a casing 11 that includes an opening 11*a*. The light source 4 may be positioned at the opening 11*a* above the movable member 2 that is arranged in the casing 11. The light source 4 may be positioned to close the opening 11*a* above the movable member 2 that is arranged in the casing 11.

Namely, the coil 12 of the movable member 2 is arranged in the magnetic gap 22*a* of the magnetic circuit 22, which is arranged in the casing 11 at a position lower than a position of the movable member 2. The light source 4 may be directly supported by the casing 11. The light source 4 includes a substrate 7 to which the LED is electrically connected. An outer surface of the casing 11 may be covered by an electrically-insulating layer 18 as shown in FIG. 1C.

If the number of LEDs arranged in a light source 4 increases and/or the size of each LED increases, the light source and/or a light-emitting device including the light source require a heat-releasing structure to release heat from the LEDs. The casing 11 may be made of metallic material and thermally connected to the light source 4. The substrate 7 may be a ceramic substrate. The substrate 7 may include a metal plate and/or a heatsink that is thermally connected to the LED and to the casing 11. The substrate 7 may include an electrically-insulating layer that is made of a resin.

Also, the light source 4 may be supported by the casing 11 through a metal plate 7' and/or a heatsink that is additionally arranged.

Furthermore, an air passage 10 may be arranged at a position below the light source 4 and above the panel 16 of the movable member 2. The air passage 10 may be arranged adjacent to the light source 4 to release heat generated in the light source 4 efficiently. The casing 11 may include an air passage 10 at a peripheral side portion of the casing 11.

The up and down movement of the coil 12 conform to up and down shapes of AC waveform. When the coil 12 on which the panel 16 is arranged is at a higher position as an up position, the movable member 2 pushes air heated by the light source 4 in the casing 11 toward outside of the casing 11 of the light-emitting device 100. When the coil 12 on which the panel 16 is arranged is at a lower position as a down position, the movable member 2 introduces air from outside of the casing 11 of the light-emitting device 100 into a space in the casing 11. Accordingly, the heated air in the casing 11 is able to be circulated to cool down the light source 4 in the light-emitting device 100.

A light-emitting device according to an embodiment of the present invention includes means for circulating air that is heated by a light source when the light source is activated; means for flowing alternating current through a coil of a movable member; and means for flowing rectified current through the light source.

FIG. 1A shows a top plan view of a light-emitting device as an embodiment of a light-emitting device.

FIG. 1B shows a top plan view of the light-emitting device shown in FIG. 1A, with a light-transmitting cover 20 removed. The light-transmitting cover 20 may be a lens. Also, the light-transmitting cover may include a curving shape.

FIG. 1C shows a side view of light-emitting device as an embodiment of the subject matter.

FIG. 1D is a cross-sectional view of light-emitting device, taken along a dotted and dashed line ID-ID shown in FIG. 1A. The air passage 10 may be positioned below the light source 4 and above the panel 16 of the movable member 2.

According to an embodiment of a light-emitting device of the present invention, a light-emitting device 100 may include a casing 11 including an opening 11*a*; a light source 4 that is supported by the casing 11. The light source 4 may be supported by an upper stepped portion of the casing 11. The light-emitting device 100 may further include a magnetic circuit 22 including a yoke 15, a permanent magnet 14 arranged in contact with the yoke 15, a top plate 17 arranged on the permanent magnet 14 to form a magnetic gap 22*a* between the top plate 17 and the yoke 15. The light-emitting device 100 may further include a movable member 2 that is positioned below the light source 4 in the casing 11 and includes a coil 12 arranged in a magnetic gap 22*a* between the top plate 17 and the yoke 15. The movable member 2 of the light-emitting device 100 may further include a panel 16 arranged on the coil 12. The light source 4 may include LEDs that are arranged in an area positioned above the panel 16 of the movable member 2. The permanent magnet 14 may be arranged in a recessed portion 15*a* of the yoke 15.

When the light-emitting device 100 is activated, the coil 12 of the movable member to which a part of AC is supplied will be activated. The movable member 2 is included in the light-emitting device. The movable member 2 is able to be activated by a small voltage of about 3 to 5 volts, for example. The AC except a part of the AC supplied to the coil 12 may be rectified by the rectifier 3 to supply a rectified current to the light source 4.

The movable member 2 includes a coil 12. The coil 12 includes a wire 12*b* winding around a bobbin 12*a*. AC is configured to be supplied to the coil 12 of the movable member 2 before being supplied to the rectifier 3.

The coil 12 of the movable member 2 is electrically positioned between an AC power source and the rectifier 3. The rectifier 3 may convert AC, which periodically reverses direction, to a rectified current, which flows in only one direction.

For more details about the magnetic gap 22*a*, the magnetic gap 22*a* is formed between a periphery of the top plate 17 and an upper portion of the yoke 15. The movable member 2 includes a coil 12, which includes a bobbin 12*a* and a wire 12*b* winding around the bobbin 12*a*. The movable member 2 may include an FPC (flexible printed circuit) 23. The FPC 23 may be partly attached to the movable member 2. Of course, the arrangement of an FPC 23 is not limited to an arrangement shown in FIG. 2A.

The light-emitting device 100 may further include a base 19 that includes a first terminal 19*a* and a second terminal 19*b*. FIG. 1C shows the first terminal 19*a* and the second terminal 19*b* as pins. Also, the base 19 may be a screw base instead of pins. The shape of the base 19 may be various shapes compatible to sockets which are already known and used.

As shown in FIG. 1B, a light source 4 includes a substrate 7. The light source 4 may include LEDs that are electrically arranged in series and/or in parallel to at least a pair of electrodes arranged on the substrate. A first electrode 8*a* arranged on a substrate 7 of the light source 4 may be electrically connected to a first electrode of the rectifier 3 by a first lead wire 9*a*. A second electrode 8*b* arranged on the substrate 7 of the light source 4 may be electrically connected to a second electrode of the rectifier 3 by a second lead wire 9*b*.

The first lead wire 9*a* may be soldered on the first electrode 8*a* of the light source at one end of the first lead wire 9*a*. The second lead wire 9*b* may be soldered on the second electrode 8*b* of the light source 4 at one end of the second lead wire. The rectifier 3 may be electrically connected to the coil 12 of the movable member 2, an AC power source 1, and the light source 4. The rectifier 3 may be a bridge rectifier.

The substrate 7 may be a resin substrate. The substrate 7 may include a metal plate 7' to which the LEDs are thermally connected. The substrate 7 may be a ceramic substrate.

According to an embodiment of the present invention, a light-emitting device including: a magnetic circuit 22 that includes a yoke 15, a permanent magnet 14 arranged in contact with the yoke 15, and a top plate 17 arranged on the permanent magnet 14 to form a magnetic gap 22*a* between the top plate 17 and the yoke 15; a movable member 2 including a coil 12 that is electrically connectable to an AC power source 1 such that AC from the AC power source flows through the coil 12 of the movable member 2; a rectifier 3 electrically connected to the AC power source 1; and a light source 4 electrically connected to the rectifier 3 such that a rectified current that originates from the AC and is rectified by the rectifier 3 flows through the light source 4.

The movable member 2 herein moves repeatedly up and down when AC flows through the movable member. When the AC power source 1 to activate the light-emitting device 100 is switched on, AC from the AC power source 1 flows through the coil 12 of the movable member 2, and AC is rectified by the rectifier 3 to be a rectified current. Then, the rectified current is configured to flow through the light source 4 that includes LEDs to emit light.

Accordingly, a magnetic force produced in the magnetic gap 22*a* moves the coil 12 with a panel 16 up and down. The up and down movement of the coil 12 conform to up and down shapes of AC waveform. When the coil 12 on which the panel 16 is arranged is at a higher position, the movable member 2 pushes air heated by the light source 4 in the casing 11 toward outside of the casing 11 of the light-emitting device 100. When the coil 12 on which the panel 16 is arranged is at a lower position, the movable member 2 introduces fresh air outside of the casing 11 of the light-emitting device 100 into a space in the casing 11. Accordingly, the heated air in the casing 11 is able to be circulated.

The air circulation in a space below the light source allows the light source to cool down when the light-emitting device is activated. It requires a small voltage to activate the movable member 2 to circulate air in this embodiment of the light-emitting device. For example, the small voltage can be around 3-5 volts. A voltage of around 220-230 volts and a frequency of 50 cycles per second are used in Europe, most of Asia, most of South America and Australia, for example.

Accordingly, the required voltage to activate the movable member in this embodiment is comparatively small to an entire amount of voltage, and with such a small voltage, the light source of the light-emitting device can be cooled down. In other words, the movable member 2 is able to be activated with a voltage falling in a range of one to five percent of an entire amount of voltage that is applicable to the light-emitting device.

Also, as another embodiment, it is possible to arrange two coils that are opposite in phase. Operating sound of the coils in a movable member may be restrained or canceled by each other of the two coils that are opposite in phase.

According to an embodiment of the subject matter, a light-emitting device 100 includes a casing 11 includes an opening; a light source 4 supported by the casing 11; an air passage 10 arranged adjacent to the light source 4; a magnetic circuit 22 including a yoke 15, a permanent magnet 14 arranged in contact with the yoke 15, a top plate 17 arranged on the permanent magnet 14 to form a magnetic gap 22*a* between the top plate 17 and the yoke 15; and a movable member 2 being positioned below the light source 4 in the casing 11 and including a coil 12 that is arranged in a magnetic gap 22*a*.

The air passage 10 connects an inside space of the casing 11 and an outside of the casing 11. If the air passage 10 is arranged adjacent to the light source 4, it is possible to circulate heated air by the light source 4 in the casing 11 and fresh air outside the casing 11 effectively. If a surface area of the air passage 10 becomes larger, heat-releasing effect of heated air may increase. Accordingly, it is possible to increase the surface area of the air passage to have a shape of slit as shown in FIG. 1C. Also, two or more air passages 10 may be arranged through the casing 11 adjacent to the light source 4. The air passage 10 may be a groove, an opening and/or a hole. With a smaller opening and/or a hole, air in the casing 11 may be circulated in a faster speed with the movement of the movable member 2.

Figure 2C:
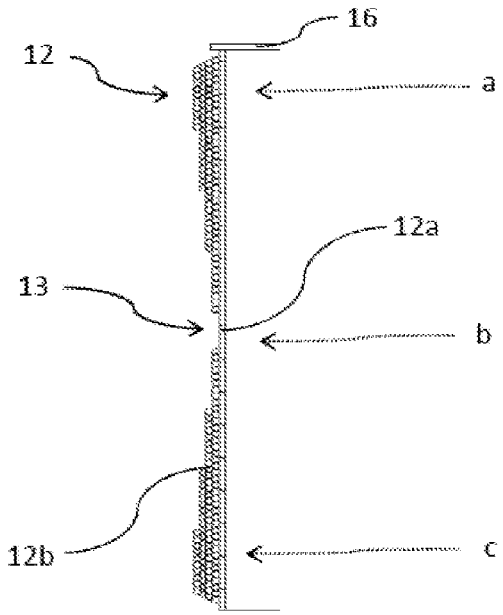
FIG. 2C is a partially enlarged cross-sectional view of a coil, shown in a dotted elliptic circle in FIG. 2B.

FIG. 2C is a partially enlarged cross-sectional view of a coil, shown in a dotted elliptic circle in FIG. 2B.

As shown in FIG. 2B and FIG. 2C, it is possible to arrange a magnetic fluid 13 arranged on an outer peripheral side of the coil 12 of the movable member 2. The magnetic fluid 13 on the outer peripheral side of the coil 12 is drawn to the coil 12 in the magnetic gap 22*a* formed between the top plate 17 and the yoke 15. Accordingly, the magnetic fluid 13 on the outer peripheral side of the coil 12 holds the coil in a position to allow the coil to start to move and/or continue to move up and down, when the light-emitting device 100 is activated. The coil 12 may include a bobbin 12*a*, and the number of turns of winding wire 12*b* of the coil 12 around an upper portion, which is shown as a dotted arrow "a" in FIG. 2C, of the bobbin 12*a* is more than the number of turns of a winding wire 12*b* of the coil 12 around a middle portion, which is shown as a dotted arrow "b" in FIG. 2C, of the bobbin 12*a* in both directions of the up and down movement of the coil shown as the both directions arrow in FIG. 2B. The number of turns of the winding wire 12*b* of the coil 12 around a lower portion, which is shown as a dotted arrow "c", of the bobbin 12*a* is more than the number of turns of the winding wire 12*b* of the coil 12 around the middle portion "b" of the bobbin 12*a* in the both directions of the up and down movement of the coil 12. This configuration may be useful for the magnetic fluid 13 on the outer peripheral side of the coil 12 to hold the coil in a position to allow the coil to start to move and/or continue to move up and down, when the light-emitting device 100 is activated. Even if the light-emitting device 100 is turned off, the coil with the magnetic fluid 13 may be able to return to a neutral position from which the coil is able to move when the light-emitting device 100 is turned on.

In addition, as an embodiment of the subject matter, the middle portion "b" of the bobbin 12*a* may be exposed from the winding wire 12*b* of the coil 12. The magnetic fluid 13 may be positioned on the middle portion of the bobbin 12*a*.

FIG. 3 shows a circuit diagram for a light-emitting device according to an embodiment of the subject matter. The reference number 1 in FIG. 3 shows an alternating current (AC) power source. In alternating current (AC), the flow of electric charge periodically reverses direction. AC is the form in which electric power is delivered to businesses and residences, and thus, the AC power source 1 is positioned outside of the light-emitting device. The movable member 2 includes a coil 12, to which an AC is supplied when the light-emitting device 100 is activated. Also, the light-emitting device 100 may include the rectifier 3, to which the alternating current is supplied when the light-emitting device 100 is activated. The light-emitting device 100 may include a light source 4, to which a rectified current rectified from the alternating current by the rectifier 3 is supplied when the light-emitting device 100 is activated. The alternating current is configured to be supplied to the coil 12 of the movable member 2 before being supplied to the rectifier 3.

Furthermore, while certain embodiments of the present inventive subject matter have been illustrated with reference to specific combinations of elements, various other combinations may also be provided without departing from the teachings of the present inventive subject matter. Thus, the present inventive subject matter should not be construed as being limited to the particular exemplary embodiments described herein and illustrated in the Figures, but may also encompass combinations of elements of the various illustrated embodiments.

Many alterations and modifications may be made by those having ordinary skill in the art, given the benefit of the present disclosure, without departing from the spirit and scope of the inventive subject matter. Therefore, it must be understood that the illustrated embodiments have been set forth only for the purposes of example, and that it should not be taken as limiting the inventive subject matter as defined by the following claims. The following claims are, therefore, to be read to include not only the combination of elements which are literally set forth but all equivalent elements for performing substantially the same function in substantially the same way to obtain substantially the same result. The claims are thus to be understood to include what is specifically illustrated and described above, what is conceptually equivalent, and also what incorporates the essential idea of the inventive subject matter.

What is claimed is:

1. A light-emitting device comprising:
a casing comprising an opening;
a magnetic circuit comprising a magnetic gap;
a movable member comprising a coil that is electrically connectable to an alternating current power source and arranged in the magnetic gap of the magnetic circuit; and
a light source comprising a light-emitting diode and arranged above the movable member,
wherein the light source is positioned to close the opening above the movable member that is arranged in the casing, and
wherein the movable member is able to be activated with a voltage falling in a range of one to five percent of an entire voltage range that is applicable to the light-emitting device.

2. The light-emitting device according to claim 1, further comprising:
a rectifier that is electrically connectable to the alternating current power source,
wherein the light source is electrically connected to the rectifier, and the rectifier is configured to rectify an alternating current originating from the alternating current power source to supply a rectified current to the light source.

3. The light-emitting device according to claim 1,
wherein the movable member further comprises a panel arranged on the coil.

4. The light-emitting device according to claim 1,
wherein the magnetic circuit comprises a yoke, a permanent magnet arranged in a recessed portion of the yoke, and a top plate arranged on the permanent magnet to form the magnetic gap between the top plate and the yoke.

5. The light-emitting device according to claim 3, further comprising:
an air passage arranged below the light source and above the panel of the movable member.

6. A light-emitting device comprising:
a magnetic circuit comprising a magnetic gap;
a movable member comprising a coil that is electrically connectable to an alternating current power source and arranged in the magnetic gap of the magnetic circuit;
a light source comprising a light-emitting diode and arranged above the movable member; and
a magnetic fluid arranged on an outer peripheral side of the coil of the movable member,
wherein the movable member is able to be activated with a voltage falling in a range of one to five percent of an entire voltage range that is applicable to the light-emitting device.

7. A light-emitting device comprising:
a magnetic circuit comprising a magnetic gap;
a movable member comprising a coil that is electrically connectable to an alternating current power source and arranged in the magnetic gap of the magnetic circuit; and a light source comprising a light-emitting diode and arranged above the movable member, wherein the movable member is able to be activated with a voltage falling in a range of one to five percent of an entire voltage range that is applicable to the light-emitting device, wherein the coil comprises a bobbin and a winding wire, a number of turns of the winding wire of the coil around an upper portion of the bobbin being more than a number of turns of the winding wire of the coil around a middle portion of the bobbin in a direction of up and down movement of the coil, and wherein a number of turns of the winding wire of the coil around a lower portion of the bobbin is more than the number of turns of the winding wire of the coil around the middle portion of the bobbin in the direction of up and down movement of the coil.

8. The light-emitting device according to claim 7, further comprising:

a magnetic fluid, wherein the middle portion of the bobbin is exposed from the winding wire of the coil, and the magnetic fluid is positioned on the middle portion of the bobbin.

9. A light-emitting device comprising:

a casing comprising an opening;

a light source supported by the casing;

an air passage arranged adjacent to the light source;

a magnetic circuit comprising a yoke, a permanent magnet arranged in contact with the yoke, a top plate arranged on the permanent magnet to form a magnetic gap between the top plate and the yoke;

a movable member positioned below the light source in the casing and comprising a coil that is arranged in the magnetic gap; and a magnetic fluid arranged on an outer peripheral side of the coil of the movable member.

10. The light-emitting device according to claim 9, wherein the coil comprises a bobbin and a winding wire, a number of turns of the winding wire of the coil around an upper portion of the bobbin being more than a number of turns of the winding wire of the coil around a middle portion of the bobbin in a direction of up and down movement of the coil.

11. The light-emitting device according to claim 9, wherein the coil comprises a bobbin and a winding wire, and wherein a middle portion of the bobbin is exposed from the winding wire of the coil, and the magnetic fluid is positioned on the middle portion of the bobbin.

12. The light-emitting device according to claim 9, wherein the movable member is able to be activated with a voltage falling in a range of one to five percent of an entire amount of voltage that is applicable to the light-emitting device.

13. A light-emitting device comprising:

a magnetic circuit comprising a yoke, a permanent magnet arranged in contact with the yoke, and a top plate arranged on the permanent magnet to form a magnetic gap between the top plate and the yoke;

a movable member comprising a coil to which an alternating current is supplied when the light-emitting device is activated;

a rectifier to which the alternating current is supplied when the light-emitting device is activated; and a light source to which a rectified current rectified from the alternating current by the rectifier is supplied when the light-emitting device is activated, wherein the coil of the movable member is configured to be supplied the alternating current before the alternating current is supplied to the rectifier, and wherein the coil of the movable member is electrically positioned between an alternating current power source and the rectifier.

14. The light-emitting device according to claim 13, wherein a first electrode of the light source is electrically connected to a first electrode of the rectifier, and a second electrode of the light source is electrically connected to a second electrode of the rectifier.

15. The light-emitting device according to claim 13, wherein the rectifier is electrically connected to the coil of the movable member, the alternating current power source, and the light source.

16. The light-emitting device according to claim 13, wherein the rectifier is a bridge rectifier.

17. The light-emitting device according to claim 13, wherein the movable member is able to be activated with a voltage falling in a range of one to five percent of an entire amount of voltage that is applicable to the light-emitting device.

* * * * *